US006401864B1

(12) United States Patent
Stringer et al.

(10) Patent No.: US 6,401,864 B1
(45) Date of Patent: Jun. 11, 2002

(54) COLLAPSIBLE STABILIZING DEVICES

(75) Inventors: Matthew D. Stringer, Archbold; Peter W. Freund, Defiance, both of OH (US)

(73) Assignee: bil-jax, inc., Archbold, OH (US)

( * ) Notice: Subject to any disclaimer, the term of this patent is extended or adjusted under 35 U.S.C. 154(b) by 0 days.

(21) Appl. No.: 09/774,499

(22) Filed: Jan. 31, 2001

(51) Int. Cl.[7] ..... E04G 1/18

(52) U.S. Cl. ..... 182/148; 182/62.5; 182/113; 182/141

(58) Field of Search ..... 182/63, 62.5, 113, 182/141, 145, 148; 187/9 R, 11

(56) References Cited

U.S. PATENT DOCUMENTS

| | | | | | |
|---|---|---|---|---|---|
| 1,503,581 | A | * | 8/1924 | Fleming | 182/148 |
| 2,354,905 | A | * | 8/1944 | Bailey et al. | 182/148 |
| 2,815,132 | A | * | 12/1957 | Stone | 182/141 |
| 3,273,574 | A | * | 9/1966 | Huddle | 182/148 |
| 3,464,519 | A | * | 9/1969 | Whisler | 182/141 |
| 3,736,987 | A | * | 6/1973 | Easterling | 172/4.5 |
| 3,790,133 | A | * | 2/1974 | Jones | 254/86 R |
| 4,872,665 | A | * | 10/1989 | Chareire | 272/70 |
| 4,932,176 | A | | 6/1990 | Roberts et al. | |
| 4,987,976 | A | | 1/1991 | Daugherty | |
| 5,111,907 | A | | 5/1992 | Kishi | |
| 5,135,074 | A | * | 8/1992 | Hornagold | 182/2 |
| 5,203,425 | A | | 4/1993 | Wehmeyer | |
| 5,271,482 | A | * | 12/1993 | Walz | 182/63 |
| 5,273,132 | A | | 12/1993 | Sasaki et al. | |
| D347,720 | S | | 6/1994 | Tamura et al. | |
| D347,917 | S | | 6/1994 | Bedsole | |
| 5,337,858 | A | | 8/1994 | Neubauer | |
| 5,417,540 | A | * | 5/1995 | Cox | 414/495 |
| 5,425,433 | A | | 6/1995 | Huber | |
| 5,487,446 | A | | 1/1996 | Patnode et al. | |
| 5,515,945 | A | | 5/1996 | Smith et al. | |
| 5,533,593 | A | * | 7/1996 | Huang | 182/141 |
| 5,584,363 | A | | 12/1996 | Curtin et al. | |
| 5,624,225 | A | * | 4/1997 | Cox | 414/495 |
| 5,657,834 | A | | 8/1997 | Plaugher et al. | |
| 5,722,505 | A | | 3/1998 | Grabner et al. | |
| 5,755,306 | A | | 5/1998 | Kraemer et al. | |
| 5,803,204 | A | | 9/1998 | White et al. | |
| D399,628 | S | | 10/1998 | Smith | |
| 5,850,892 | A | | 12/1998 | Citron et al. | |
| 5,875,869 | A | | 3/1999 | Busuttil et al. | |
| 5,890,559 | A | | 4/1999 | Busuttil et al. | |
| 6,142,501 | A | * | 11/2000 | Fogo et al. | 280/475 |

OTHER PUBLICATIONS

Brochure of Aerial 13, Hydraulic Stabiliser, 2 pages.

* cited by examiner

*Primary Examiner*—Bruce A. Lev
(74) *Attorney, Agent, or Firm*—Emch, Schaffer, Schaub & Porcello Co., LPA

(57) ABSTRACT

A stabilizing system includes at least one outrigger assembly. Each outrigger assembly has a pivotable first leg operably connected to a second leg. At least one locking mechanism is operatively mounted to the pivotable first leg and the second leg. At least one sensing mechanism is connected to the first leg for detecting when the first and second legs are in a stabilized position.

10 Claims, 6 Drawing Sheets

COLLAPSIBLE STABILIZING DEVICES

FIELD OF THE INVENTION

This invention is directed to a stabilizing assembly and more specifically, a stabilizing assembly for use with personnel lifts that are manually transportable between locations and can be readily set up.

BACKGROUND OF THE INVENTION

Personnel lifts are used for many applications. The personnel lifts generally have aerial work platforms which are raised or lowered to position a worker at a desired height. The aerial platforms are used to gain access to overhead lighting fixtures, heating and air conditioning ducts, ceilings and the like.

The personnel lift typically includes the aerial work platform surrounded by a protective personnel cage or basket. The aerial platform and personnel basket are attached to a vertical lift, or mast, assembly. The vertical mast assembly includes multiple extendible nested sections mounted on a base. The personnel lift also includes a device to stabilize the personnel lift when the personnel basket or cage is in an elevated position. After the personnel lift is securely stabilized, the worker enters the personnel basket and operates controls to raise and lower the aerial platform.

The worker often moves the personnel lift to several different overhead locations in the course of one day. The worker must move the personnel lift from one location to another because the worker is limited to working in an area which is within an arm's reach of the aerial platform. When the worker desires to do work beyond that reach, the worker must lower the aerial platform, exit the personnel basket, release the device stabilizing the personnel lift, and move the personnel lift to the next desired location. The worker repeats the process of securing and stabilizing the personnel lift and doing work in the next desired location.

Each of these steps is time consuming since the worker must carefully maneuver the personnel lift to a desired location, often through doorways and around overhead obstructions such as light fixtures and side obstructions such as a narrow aisleways. In the past, personnel lifts had devices to stabilize the lift which were both bulky and difficult to operate.

It is an especially time consuming and sometimes difficult task to securely stabilize the personnel lift. Often, the work platform is used in a warehouse type environment or in an environment under construction. The floor is not always even and stabilizing the personnel lift takes a great amount of time and adjustment.

There is a need in the industry for a more efficient personnel lift assembly that is easily moved to a variety of locations.

There is a further need for an efficient stabilizing device for a personnel lift assembly that is quickly and easily stabilized.

There is a further need for a personnel lift assembly that is easy to move and pivot within a small radius for maneuvering in compact or close areas and yet provides a large, stabilizing footprint when the personnel lift is being used.

It is therefore an object of this invention to provide a stabilizing device which is useful in many applications, and, in particular, for personnel lift assembly which is a easily maneuverable and readily stabilized.

SUMMARY OF THE INVENTION

The present invention provides a stabilizing outrigger system for a moveable object. In accordance with the present invention, a personnel lift having a stabilizing outrigger system is described in detail. It should be understood, however, that the stabilizing outrigger system of the present invention is useful for stabilizing and securing different types of moveable objects and that such uses are within the contemplated scope of the present invention. However, for ease of explanation, the stabilizing outrigger system of the present invention will be described in detail herein in connection with a personnel lift.

The personnel lift includes a base having center mounted wheels and a plurality of rotatable or caster wheels on the corners of the base. A stabilizing system having a plurality of outrigger assemblies is operatively attached to the base. Each outrigger assembly pivotedly extends from a collapsed, or closed, position to an open, or stabilizing, position. Each outrigger assembly is independently adjustable such that the personnel lift is securely stabilized on any type of surface. The stabilizing system of the personnel lift provides a greatly enlarged footprint such that the personnel lift is securely stabilized on any type of surface.

Each outrigger assembly has a pivotable first leg operatively connected to a second leg and at least one slidable locking mechanism which operatively connects the first pivotable leg to the second leg.

The locking mechanism has a first sleeve which is coaxially positioned on at least a part of the first pivotable leg. The locking mechanism has a second sleeve which is coaxially positioned on at least a part of the second leg. The first sleeve and second sleeve of the locking mechanism are generally parallel to each other and are operatively connected to each other.

The locking mechanism includes an adjustment device operatively connected to the second leg. The adjustment device allows the second leg to be moved with respect to the first leg. In a preferred aspect, the adjustment device includes a gear mechanism having a first gear and a second gear in mating engagement with the first gear. The second gear is operatively connected to a screw which is axially positioned within the second leg. As the first gear is moved, the first gear causes the second gear to move which then causes the screw to turn. The second leg moves axially along the screw thereby moving the second leg with respect to the first leg. The second leg is moved with respect to the first leg until the outrigger device is in a stabilized position and the personnel lift is "leveled". That is, the lengths of the first and second legs of each independent outrigger device are independently adjusted such that the personnel lift is completely level and is safe to be raised to an elevated, working position.

The outrigger assembly also includes a sensing mechanism for detecting when the first and second legs are in the stabilized position. In a preferred aspect, the sensing mechanism comprises a magnetic member mounted on a distal end of the first leg. The magnetic member is sensed by a magnetic sensor when the first and second legs are in a locked and securely stabilized position. The sensing mechanism can also prevent the aerial platform/basket assembly from being raised until the sensor mechanism receives an indication that all the individual outrigger assemblies are securely stabilized on the ground and that the platform/basket assembly can be raised in a vertical direction.

Due to the stabilizing system with the outrigger assemblies, the thus configured personnel lift can be easily stabilized by independently adjusting each outrigger assembly.

The invention, together with the advantages thereof, may best be understood by reference to the following description taken in connection with the accompanying drawings.

DETAILED DESCRIPTION OF THE PREFERRED EMBODIMENT

Figure 1:
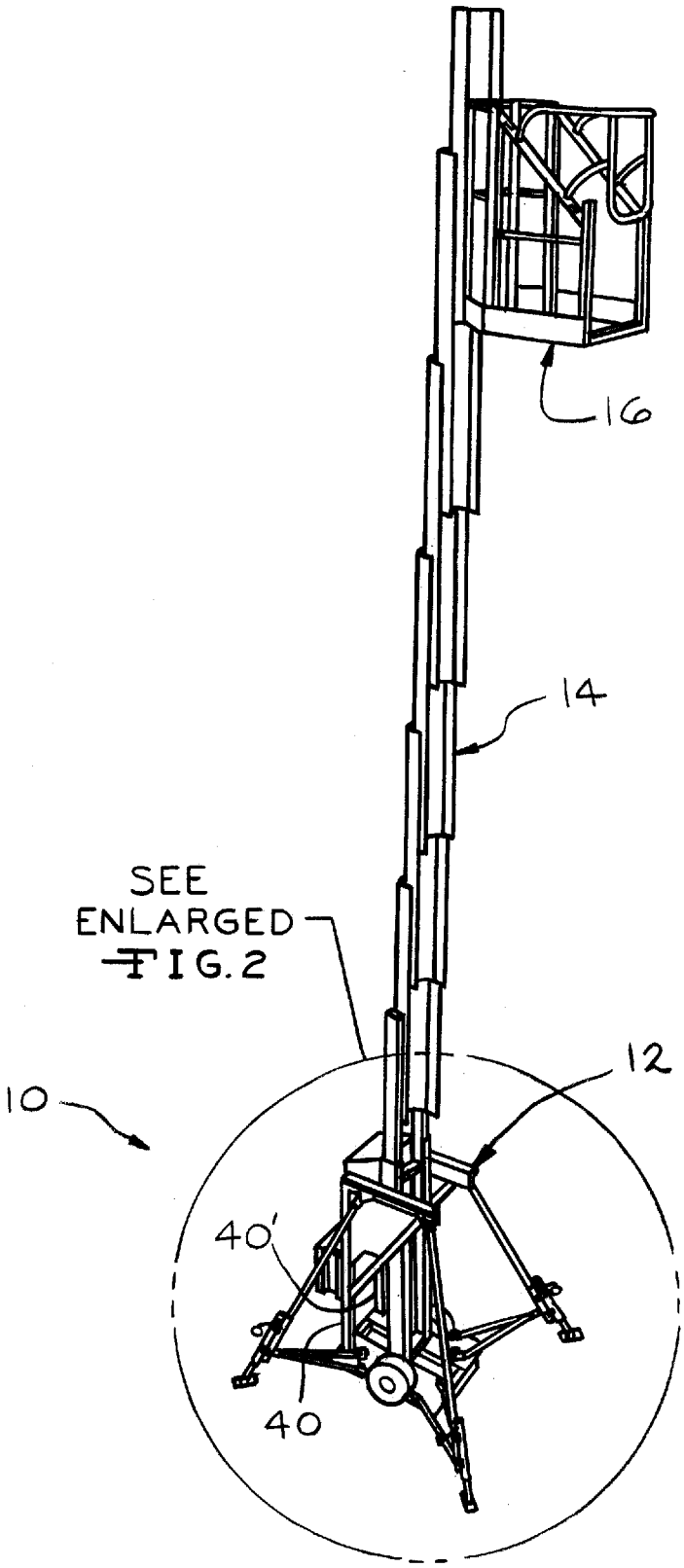
FIG. 1 is a perspective view of a personnel lift of the present invention with an aerial platform in a raised position.

A personnel lift 10 includes a base assembly 12, a mast assembly 14 mounted to the base assembly 12, and an aerial platform/basket assembly 16 operatively connected to the mast assembly 14.

The base assembly 12 includes a base 20. The mast assembly 14 is preferably mounted at or adjacent the center of the base 20. The base 20 includes a pair of opposed wheels 22 and 24 which are mounted on an axle 26. The axle 26 extends from a first side 27 of the base 20 to a second side 28 of the base 20. The wheels 22 and 24 are substantially in the center of the base 20. The base 20 includes a plurality of rotatable wheels or casters 30 which are mounted on a lower surface 32 of the base 20. The casters 30 preferably are mounted in opposed corners of the base 20. The casters 30 allow the base 20 to be easily pivoted in a small radius.

The base 20 has an upper surface 34. A frame 40 extends from the upper surface 34 of the base 20. The frame 40 is positioned on a first end 41 of the base 20. The frame 40 includes at least one vertically extending member 42 which is mounted adjacent a first corner 21 of the base 20. The frame 40 has a first end 44 mounted on the base 20 and a second end 46 which is opposed to the first end 44. An extending frame member 50 is operatively mounted to the second end 46 of the frame member 42. In the embodiment shown, the extending frame member 50 can include a generally horizontally extending member 52 and a support brace 54.

Figure 2:
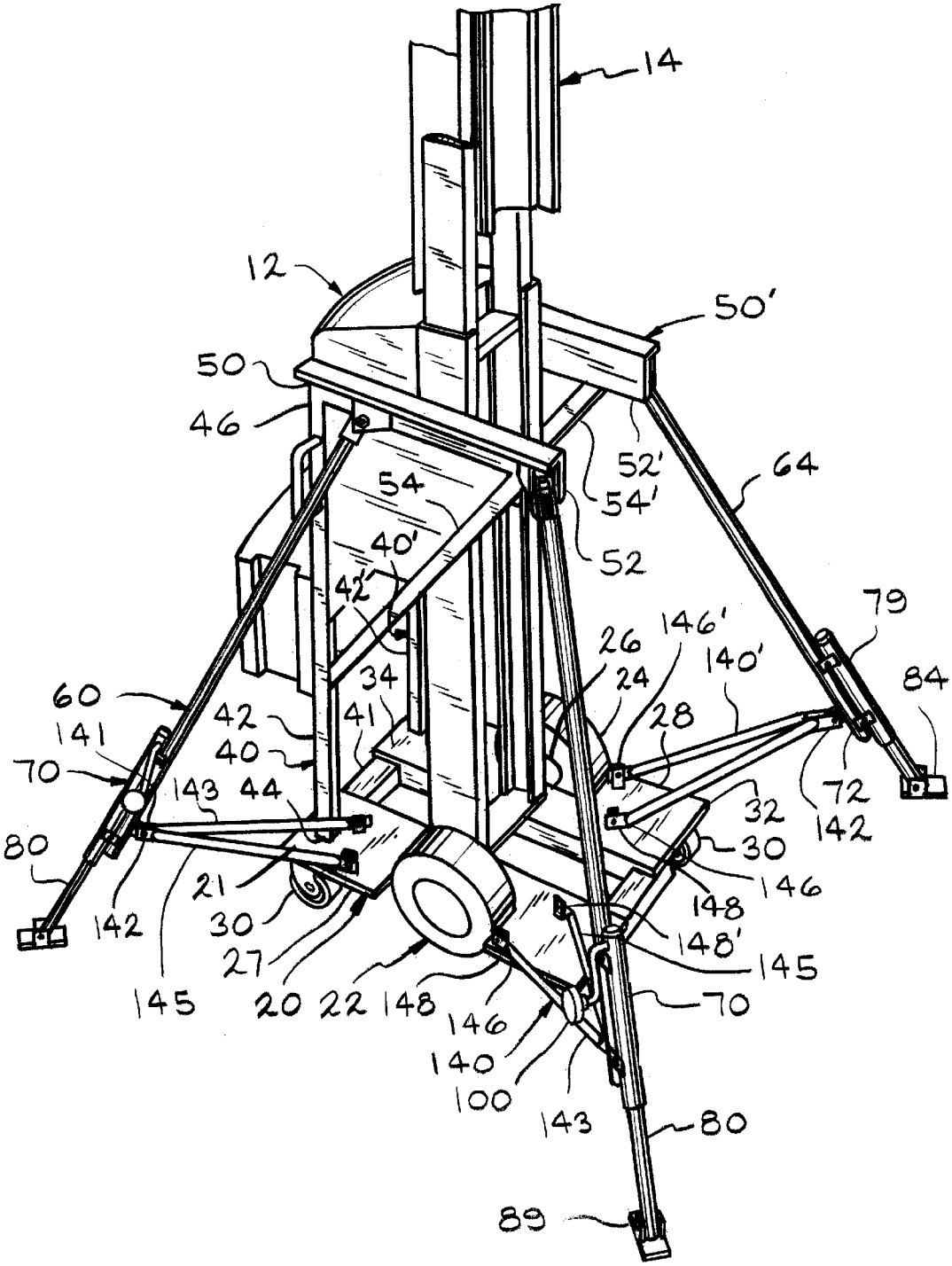
FIG. 2 is an enlargement of the area shown in FIG. 1 showing a stabilizing system.

In a similar manner, a further frame 40', as shown in FIG. 1, is mounted on an opposed corner of the base 20. For ease of explanation, the numbers referring to similar parts will be referenced as prime numbers. The opposing frame 40' comprises a vertically extending member 42', as shown in FIG. 2, and an extending frame member 50' which has a horizontally extending member 52' and a support brace 54'.

A stabilizing system 60, which comprises a plurality of stabilizing or outrigger assemblies 62, is operably attached to the base assembly 12. In the embodiment shown, the personnel lift 10 has four outrigger stabilizing assemblies 62, one mounted at each opposing corner of the base 20. However, it should be understood that in certain embodiment that either fewer or more stabilizing assemblies 62 can be utilized to provide stability to the personnel lift. For ease of explanation, only one outrigger stabilizing assembly 62 will be described in detail. It should be understood, however, that each stabilizing assembly 62 can have substantially the same configuration and, as such, is within the contemplated scope of the present invention.

Figure 3:
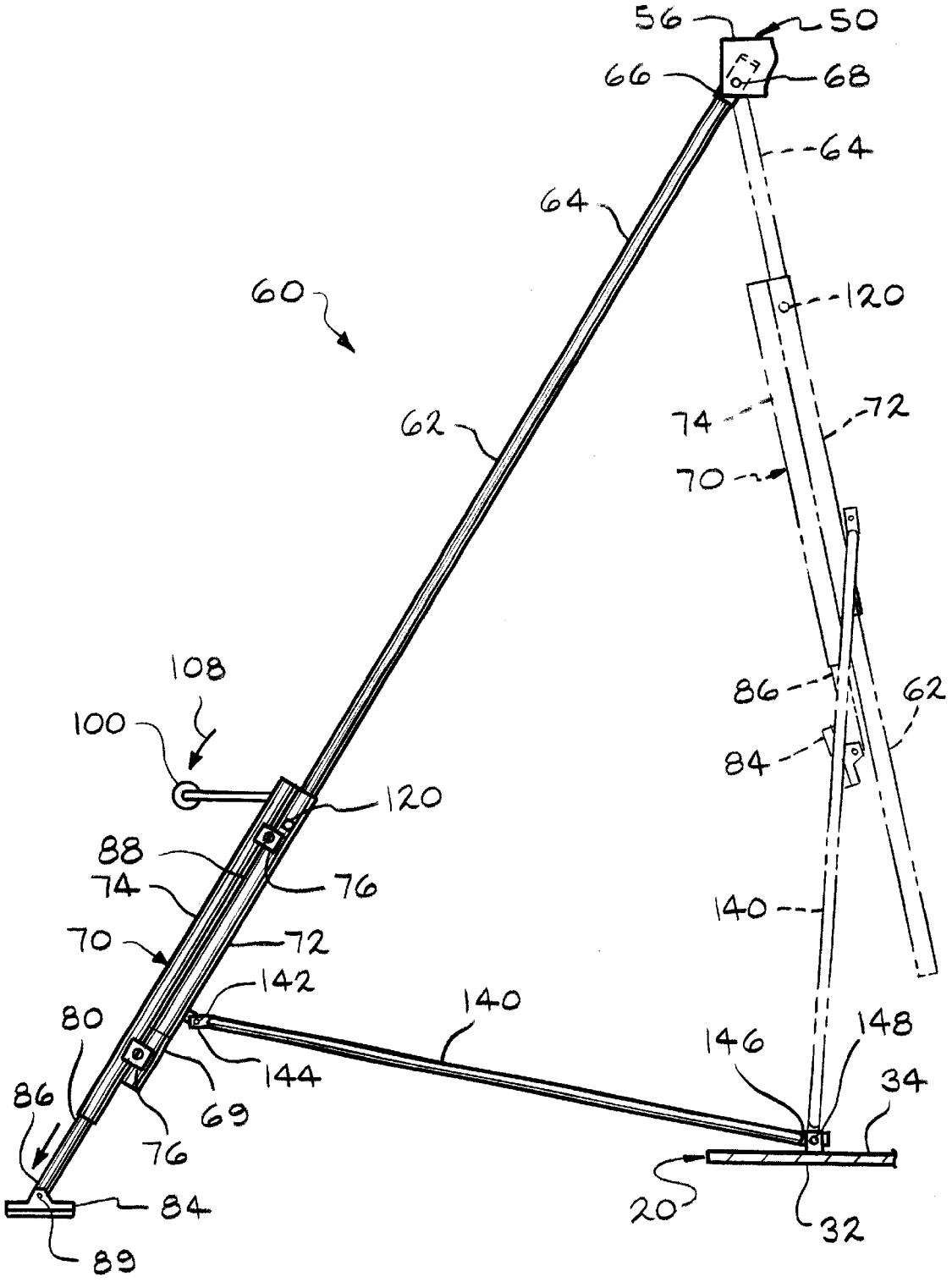
FIG. 3 is a side elevational view showing a stabilizing system in a first or open position and showing, in phantom, in a second or closed position.

Referring now in particular to FIG. 3, each stabilizing assembly 62 generally includes a first leg 64 having a first end 66 which is pivotedly attached to the frame 40 by a pivot mechanism 68 on a bracket 56 on the extending frame member 50. The first leg 64 has a second end 69 which is in opposed relationship to the first end 66. The stabilizing assembly 62 further includes a locking mechanism 70 which axially receives the second end 69 of the leg 64.

The locking mechanism 70 generally comprises a first sleeve 72 which axially receives the second end 69 of the first leg 64 and a second sleeve 74. The second sleeve 74 is operatively mounted to the first sleeve 72 by suitable mounting brackets 76 or other suitable securing devices. In the embodiment shown, the first sleeve 72 and the second sleeve 74 are parallel. The second sleeve 74 receives a second leg 80 of the stabilizing assembly 62. The second leg 80 has a first end 86 and a second end 88. The second leg 80 includes a foot member 84 which is pivotally connected to the first end 86 of the leg 80. The foot 84 is pivotedly positioned on the end 86 by a pivot means 89 such that the foot 84 can be securely positioned against any ground or surface, including any surface which may be uneven. The second end 88 of the second leg 80 is axially received within the second sleeve 74 of the locking mechanism 70. The second end 88 terminates at a point spaced apart from a top end 75 of the second sleeve 74.

Figure 6:
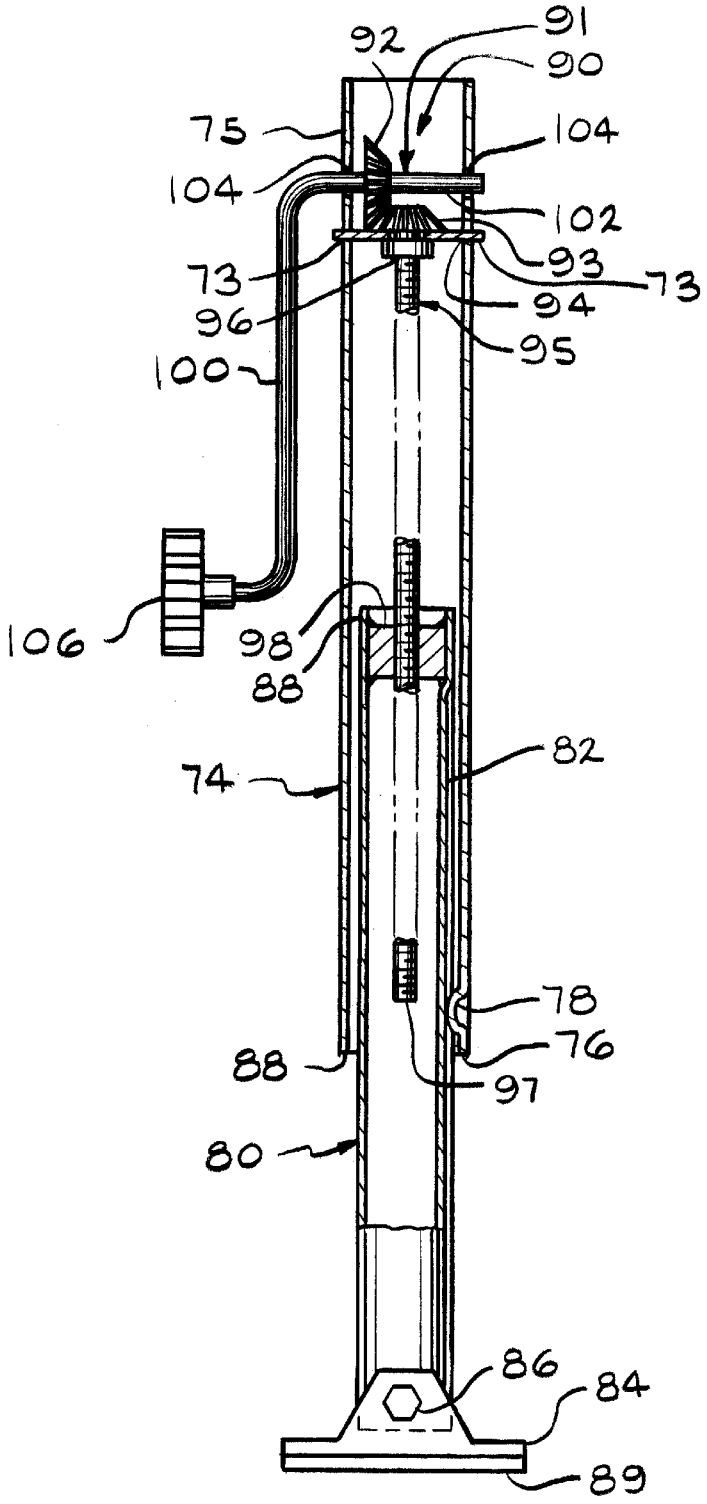
FIG. 6 is a side elevational view, partially in phantom and partially in cross-section, of a device for adjusting a locking mechanism of the stabilizing system.

The locking mechanism 70 includes an adjustment device 90, as best seen in FIG. 6, for moving the second leg 80 with respect to the first leg 64. In the embodiment shown, the adjustment device 90 comprises a gear mechanism 91 mounted on a radially extending support such as a handle 100. The gear mechanism 91 is coaxially positioned in the second sleeve 74. The handle 100 includes a radially extending section 102 which extends through opposing openings 104 in the second sleeve 74. The handle 100 includes a device for causing the gear mechanism to turn, such as a gripping member 106.

The gear mechanism 91 includes a first gear 92 axially positioned on the extending section 102 of the handle 100. The first gear 92 matingly engages a second gear 93. In the embodiment shown, the first gear 92 is at a substantially right angle with respect to the second gear 93. The second gear 93 is held in position within the second sleeve 74 by a securing plate member 94 which extends through opposing openings 73 in the second sleeve 74. The second gear 93 is operatively attached to a screw 95 which is coaxially positioned within the second sleeve 74. The screw 95 has a first end 96 which is operatively connected to the second gear 93 and a second opposing end 97.

The second end 97 of the screw 95 axially extends into the second leg 80. A threaded member 98 is axially positioned in the first end 88 of the second leg 80. The screw 95 engages and extends through the threaded member 98.

The second leg 80 is prevented from circumferentially, or radially, turning within the second sleeve 74 by a suitable restraining device. In the embodiment shown, the second sleeve 74 defines a detent 78 which engages a longitudinally extending groove 82 on the exterior of the second leg 80. The engagement of the detent 78 in the groove 82 prevents the second leg 80 from turning or rotating within the second sleeve 74, while simultaneously allowing the second leg 80 to be axially moved with respect to the second sleeve 74. It is within the contemplated scope of the present invention, however, that the second sleeve can define a groove (not shown) and the second leg define a detent (not shown) in order to prevent rotation of the second leg 80 within the second sleeve 74.

The rotation of the handle 100, which is turned in the direction of the arrow 108, as shown in FIG. 3, causes the first gear 92 to rotate the second gear 93. The rotation of the second gear 93 causes the screw 95 to turn. The turning of the screw 95 causes the threaded member 98 to be axially moved along the screw 95. As the threaded member 98 is axially moved along the screw 93, the second leg 80 is axially moved within the second sleeve 74. The longitudinal engagement of the detent 78 with the groove 82 prevents the second leg 80 from circumferentially rotating within the second sleeve 74.

Figure 4:
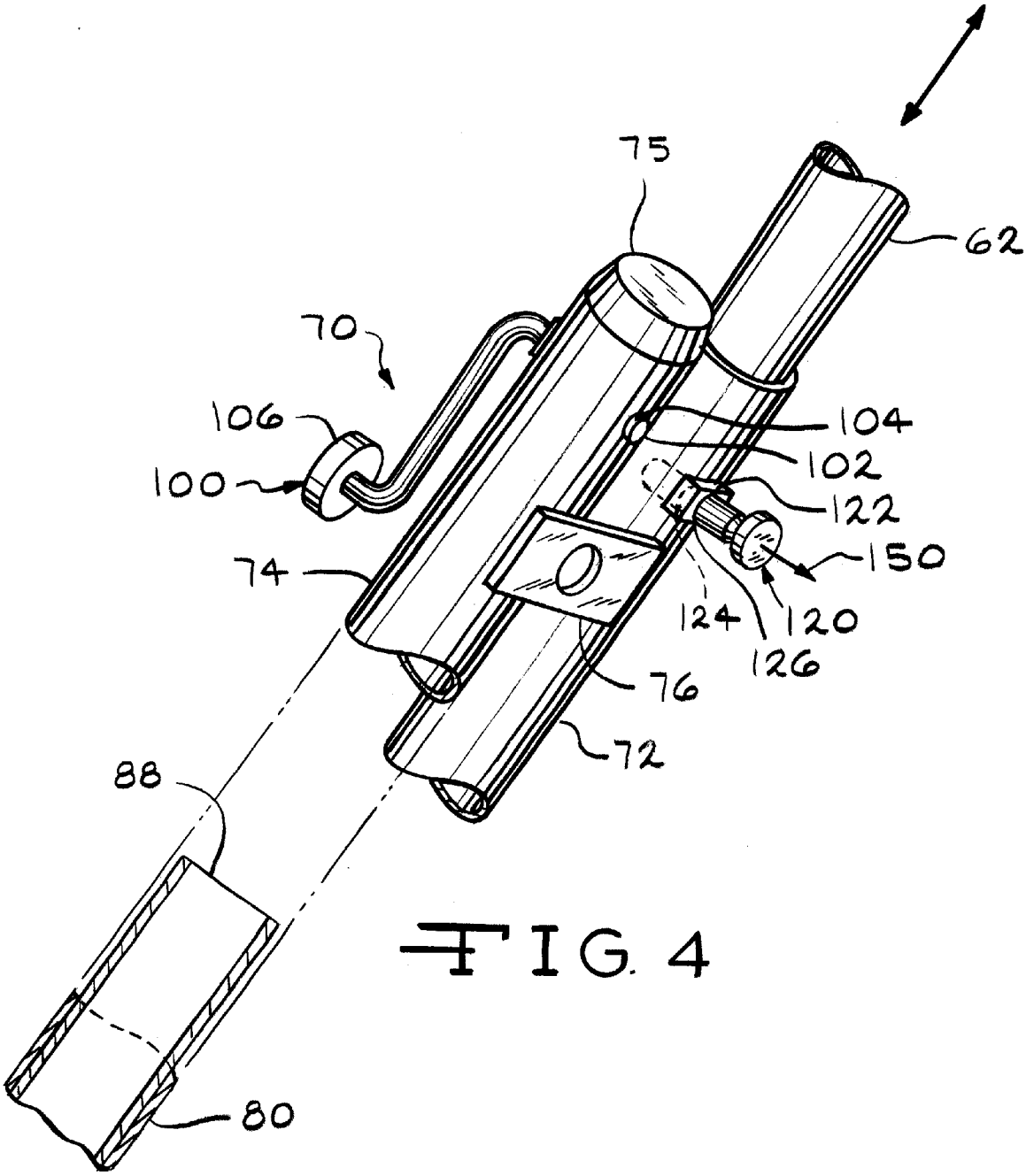
FIG. 4 is a perspective view, partially in phantom, of a locking mechanism of the stabilizing system shown in FIG. 3.

Referring now to FIG. 4 in particular, the locking mechanism 70 further includes a radially extending pin member 120 which is under tension while the outrigger system 60 is being set in position. A first end 126 of the pin 120 contacts a part of the exterior surface of the first leg 64 when the outrigger assembly 62 is in the closed and partially open positions. As the outrigger assembly 62 is pivoted to an open and stabilized position, the locking mechanism 70 axially slides along the first leg 64 until the locking mechanism 70 reaches an open position where the pin 120 is in alignment with an opening 124 in the first leg 64. At the open position, the pin 120 also extends through an opening 122 in the first sleeve 72. The pin 120 secures the first leg 64 in the first sleeve 72 of the locking mechanism 70 such that the first leg 64 is prevented from axially moving in the first sleeve 72.

Referring now to FIGS. 1 and 3, each stabilizing assembly 62 further includes a support brace 140 having a first arm 143 and a second arm 145. The first arm 143 and the second arm 145 form a stabilizing angled shape. The first arm 143 and the second arm 145 each have first ends, 141 and 142, respectively, which are operatively connected to the first sleeve 72 with a rotatable member or pivot pin 144. The first and second arms 143 and 145 each have a second end 146 and 146', respectively, which are pivotedly attached by separate pivot means 148 and 148', respectively, to the base 20. The first arm 143 and second arm 145 each extend from the first sleeve 72 at a desired angle to the separate pivot points 148 and 148' on the base 20. The first and second arms 143 and 145 allow the stabilizing assembly 62 to be easily pivoted between an open position and a closed position.

When the stabilizing assemblies 62 are to be collapsed, the worker pulls the pin 120 in a radial direction, as shown by the arrow 150 in FIG. 4. The locking mechanism 70 is axially moved in an upward direction along the first leg 64, such that the first sleeve 72 axially moves in an upward direction towards to the first end 66 of the first leg 64. Thus, when the stabilizing system 60 is moved to a closed or retracted position, the stabilizing assembly 62 pivots about the pivot point 68, the pivot point 142, and the pivot points 148 and 148' to a closed or collapsed, position and is stored adjacent the frame 40.

In order to position the stabilizing system 60 in an open working condition, the worker pivotedly moves each stabilizing assembly 62 about the pivot pins 68, 142, 148 and 148' to an open position such that the foot 80 contacts the ground or surface. As the locking mechanism 70 slidably moves along the first leg 64 in a downward direction, the pin 120 comes into alignment with the opening 122 in the first leg 64. The tension loaded pin 120 "pops" or extends through the opening 124 in the first leg 64 and through the opening 122 in the first sleeve 72, thereby preventing any further movement of the locking mechanism 70 along the first leg 64.

Referring now to FIGS. 3 and 4 in particular, the handle 100 is rotated to move the locking mechanism 70 in an axially downward direction along the second leg 80, as the second leg 80 engages the ground. After the first leg 64 is locked in position in the locking mechanism 70, the continued rotation of the handle 100 causes the first leg 64 to move in a generally axially upward direction, as described above.

Figure 5:
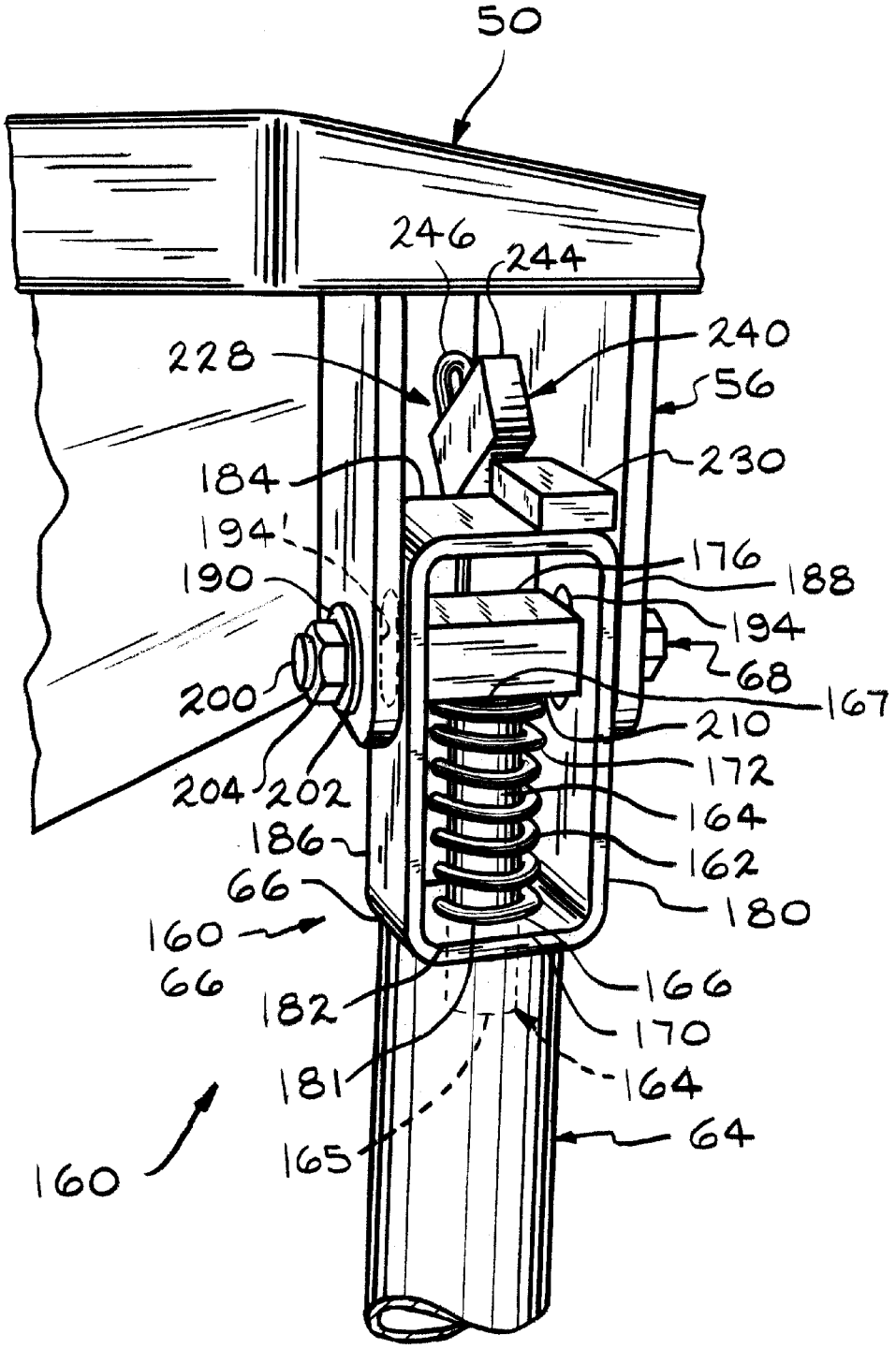
FIG. 5 is a perspective view of a top section of the stabilizing system.

Referring now in particular to FIG. 5, the second end 66 of the first leg 64 includes a sensing mechanism 160. The sensing mechanism 160 generally includes a tension device such as a spring 162 axially mounted around a support tube 164. The spring 162 has a first end 166 which engages a lower end 170 of a housing 180 of the sensing mechanism 160. The spring 162 has a second end 172 which is in a spaced apart relationship to the first end 166. The second end 172 is in contact with an engaging bar 176. The engaging bar 176 is operably connected to the support tube 164.

The housing 180 of the sensing mechanism 160 is mounted to the bracket 56 on the extending frame member 50. The housing 180 generally has a bottom 182, a top 184 and opposing sides 185 and 188. The pivot means 68 extends through a pair of opposing openings 190 in the bracket 56 and through axially extending slots 194 and 194', (slot 194' being shown in phantom), defined in each side 186 and 188, respectively, of the housing 180. The pivot means 68 generally includes a pivot pin 200 which radially extends through the openings 190 and slots 194 and 194'. The pivot pin 200 extends through the engaging bar 176. The pivot pin 200 can be secured by any suitable device such as washer 202 and nut 204.

A first end 165 of the support tube 164 extends through an opening 181 in the bottom of 182 of the housing 180. The support tube 164 extends through the opening 181. A second end 167 of the support tube 164 contacts the engaging bar 176 and aligns the pivot pin 200 in the slots 194 and 194' in the housing 180.

Positioned on the top 184 of the housing 180 is a sensing mechanism 228 for detecting when the first leg 64 and the second leg 80 are in the stabilized position. The sensing mechanism 228 includes a magnetic member 230. The magnetic member 230 is in a spaced apart relationship to a magnetic sensor 240 which is mounted on the frame member 50. The magnetic sensor 240 includes a magnetic sensing device 244 which is operatively connected by suitable wires 246 or other means to a computer or other readout device (not shown).

When the first leg 64 is moved in an axially upward direction, the spring 162 is compressed and presses against a bottom surface 210 of the engaging bar 176. As the pivot pin 200 within the engaging bar 176 slides in the axially extending slots 194 and 194' in an axially upward direction, the housing 180 is moved in a direction toward the magnetic sensor 240. As the magnetic member 230 comes within a desired position adjacent the magnetic sensor 240, the magnetic sensor 240 senses the magnetic energy and indicates that the outrigger assembly 62 of the stabilizing system 60 is level and secured.

Although the present invention has been described with respect to its preferred embodiments, those skilled in the art will recognize changes which may be made in the aforementioned structure which do not depart from the spirit of the invention already described in the specification and embodied in the following claims.

We claim:

1. A stabilizing system comprising at least one outrigger assembly having a pivotable first leg operably connected to a second leg, at least one slidable locking mechanism operatively connected to the pivotable first leg and the second leg, at least one sensing mechanism for detecting when the first leg and the second leg are in a stabilized position, the locking mechanism comprising:

(i) first sleeve which is in coaxial alignment with an axis extending through the first leg, the first sleeve being coaxially positioned on at least a part of the pivotable first leg; and, (ii) a second sleeve which is in coaxial alignment with an axis extending through the second leg, the second sleeve being coaxially positioned on at least a part of the second leg, the locking mechanism includes an adjustment device mounted within a part of the second sleeve for moving the second leg with respect to the first leg, wherein the adjustment device comprises a gear mechanism having a first gear and a second gear in mating engagement with the first gear, the second gear being operatively connected to a screw axially positioned within the second leg, the screw being threadingly engaged by the second leg.

2. The stabilizing system of claim 1, wherein the first sleeve is parallel to the second sleeve.

3. A stabilizing system comprising at least one outrigger assembly having a pivotable first leg operably connected to a second leg, at least one slidable locking mechanism operatively connected to the pivotable first leg and the second leg, at least one sensing mechanism for detecting when the first leg and the second leg are in a stabilized position, wherein the sensing mechanism comprises a magnetic member and a magnetic sensor, the magnetic sensor detecting the magnetic member when the first and second legs are in the stabilized position.

4. The stabilizing system of claim 3, wherein the magnetic member is connected to a tension device coaxially positioned adjacent a first end of the first leg.

5. A personnel lift comprising a base, a lift assembly attached to the base, a personnel carrier attached to the lift assembly, and a stabilizing system attached to the base, the stabilizing system comprising at least one outrigger assembly having a pivotable first leg operably connected to a second leg, at least one locking mechanism operatively connected to the pivotable first leg and the second leg, and at least one sensing mechanism for detecting when the first leg and the second leg are in a stabilized position, wherein the locking mechanism comprises a first sleeve which is in coaxial alignment with an axis extending through the first leg and is coaxially positioned on at least a part of the pivotable first leg and a second sleeve which is in coaxial alignment with an axis extending through the second leg and is coaxially positioned on at least a part of the second leg.

6. The personnel lift of claim 5, wherein the locking mechanism includes an adjustment device mounted within a part of the second sleeve for moving the second leg with respect to the first leg.

7. The personnel lift of claim 6, wherein the adjustment device comprises a gear mechanism having a first gear and a second gear in mating engagement with the first gear, the second gear being operatively connected to a screw axially positioned within the second leg, the screw being threadingly engaged by the second leg.

8. The personnel lift of claim 5, wherein the first sleeve is parallel to the second sleeve.

9. A personnel lift comprising a base, a lift assembly attached to the base, a personnel carrier attached to the lift assembly, and a stabilizing system attached to the base, the stabilizing system comprising at least one outrigger assembly having a pivotable first leg operably connected to a second leg, at least one locking mechanism operatively connected to the pivotable first leg and the second leg, and at least one sensing mechanism for detecting when the first leg and the second leg are in a stabilized position, wherein the sensing mechanism comprises a magnetic member and a magnetic sensor, the magnetic sensor detecting the magnetic member when the first and second legs are in the stabilized position.

10. The personnel lift of claim 9, wherein the magnetic member is connected to a tension device coaxially positioned adjacent a first end of the first leg.

* * * * *